United States Patent [19]

Scott

[11] 4,089,401

[45] May 16, 1978

[54] SEGMENTED PRINTOUT DEVICE

[76] Inventor: Thaddeus Leroy Scott, 360 Hyde Dr., Hayward, Calif. 94544

[21] Appl. No.: 840,566

[22] Filed: Oct. 11, 1977

Related U.S. Application Data

[63] Continuation-in-part of Ser. No. 731,449, Oct. 12, 1976, abandoned.

[51] Int. Cl.[2] ..... B41J 7/00

[52] U.S. Cl. ..... 400/125.1; 178/17 C; 101/93.37; 335/258; 335/281

[58] Field of Search ..... 101/93.30–93.33, 101/93.37, 93.47; 197/98.1 R, 107; 335/258, 263, 281; 340/365 E, 365 R; 178/33 R, 17 C

[56] References Cited

U.S. PATENT DOCUMENTS

| | | | |
|---|---|---|---|
| 2,766,686 | 10/1956 | Forenko et al. | 101/93.31 |
| 3,128,694 | 4/1964 | Kittler | 101/93.33 |
| 3,528,368 | 9/1970 | Oberholtzer | 101/93.31 |
| 3,848,527 | 11/1974 | Nihira | 101/93.31 |
| 3,955,498 | 5/1976 | Scott | 101/93.31 |
| 4,008,448 | 2/1977 | Muggli | 335/258 |

*Primary Examiner*—William Pieprz
*Attorney, Agent, or Firm*—Harris Zimmerman

[57] ABSTRACT

A printout device for calculators and the like includes a plurality of print segments, each encased in elastomer and embedded in a rigid block with the lower, indicia forming ends flush with the lower surface of the block. The upper end of each print segment is provided with a diametrically extending slot. Disposed above each print segment and axially aligned therewith is an electromagnetic driver element which is provided with a diametrically extending bar or key projecting from the lower surface thereof. With the electromagnet unactuated, downward pressure applied to the upper surface of the block will drive the key into the aligned slot so that no force will be transmitted to the printing segment. Actuation of the electromagnet will cause the key to be attracted to the upper extremities of the printing segment as it approaches it, causing the key to misalign with the slot and impinge on the upper surface of the printing segment. The force thus transferred drives the segment to print on a printing surface subjacent to the block.

7 Claims, 7 Drawing Figures

SEGMENTED PRINTOUT DEVICE

REFERENCE TO RELATED APPLICATION

This application is a continuation-in-part of application Ser. No. 731,449, filed Oct. 12, 1976, now abandoned.

BACKGROUND OF THE INVENTION

Although tremendous developments have taken place in recent years in the sophistication and computing power of hand-held calculators, the very diminutive size and low power requirements of these devices have perpetuated their major drawback. That is, a printout device having low current requirements has not been made commercially feasible.

It has been shown that most of the errors introduced into computations made with hand-held calculators are due to input errors or to mistakes in transferring the answer from the readout to paper. Due to the low current availability of these small, portable devices having small batteries, the readout portion of these machines has generally been limited to visual displays such as LED segment displays, liquid crystal light reflecting displays, or the like. The power requirements and size of prior art printout devices have made them incompatible with hand-held calculators. The lack of hard copy printout from these machines has been their major drawback.

SUMMARY OF THE INVENTION

The present invention generally comprises a very low current printout device which is designed to be compatible with a hand-held calculator. The power for the printing stroke is provided manually, while the selection of indicia printed is controlled electrically.

The printout device includes a plurality of paramagnetic printing segments arrayed in seven or more segment groups so that each group may print any letter or numeral. The printing end of each segment is formed as a printing bar extending from the shaft of the segment. The end of the shaft is provided with a diametrically extending slot. The printing segments are each encased in an elastomer material and secured with a rigid block, with the printing bars disposed flush with the lower surface of the block.

The invention also includes a plurality of electromagnet driver elements, one for each printing segment. Each driver element is aligned axially with its associated printing segment and disposed thereabove in the block. The lower end of each driver element is provided with a diametrically extending key projecting therefrom and adapted to be received with narrow clearance in the slot of the associated printing segment. The key has parallel, nonorthogonal ends disposed in a rhombic form. A layer of elastomer material is disposed between the array of printing segments and the array of electromagnetic driver elements.

When downward pressure is applied to the block either manually or through mechanical means, the elastomer layer compresses and the driver elements translate slightly toward the printing segments. With the electromagnets unactuated, the keys are aligned with their associated slots. As the driver elements translate the keys are driven into their slots, and no force is transferred to the printing segments.

Should any of the electromagnets be actuated, the driver element key becomes a pole of the electromagnet and the distal, rhombic ends are attracted to the adjacent respective ends of the printing segment. When downward pressure is applied to the block and the driver elements translate toward the printing segments, the key ends are attracted to the nearest respective portions of the printing segment, which are the areas surrounding the slot. This attraction causes the electromagnet to rotate slightly, misaligning the key and the slot. The key impinges on the end of the printing segment, causing it to resiliently extend from the block and strike the printing surface.

THE DRAWING

DESCRIPTION OF THE PREFERRED EMBODIMENT

Figure 1:
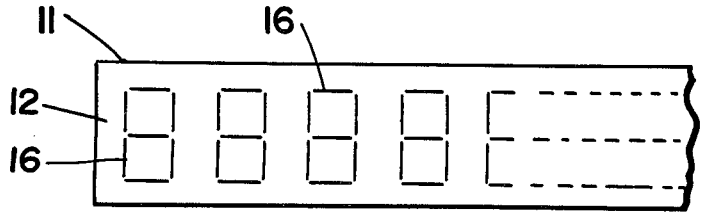
FIG. 1 is a plan view of the printing face of the segmented printout device of the present invention.
Figure 2:
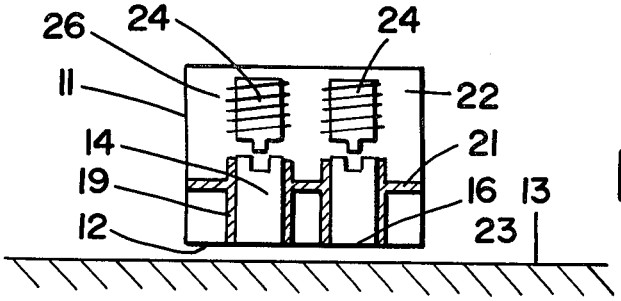
FIG. 2 is a cross-sectional elevation of the segmented printout device of the present invention.

With reference to FIGS. 1 and 2, the present invention includes a printing block 11 which has a printing surface 12 adapted to impinge on a printing surface 13. The printing surface may be any pressure sensitive material, such as carbon ribbon, treated paper, or the like.

Figure 3:
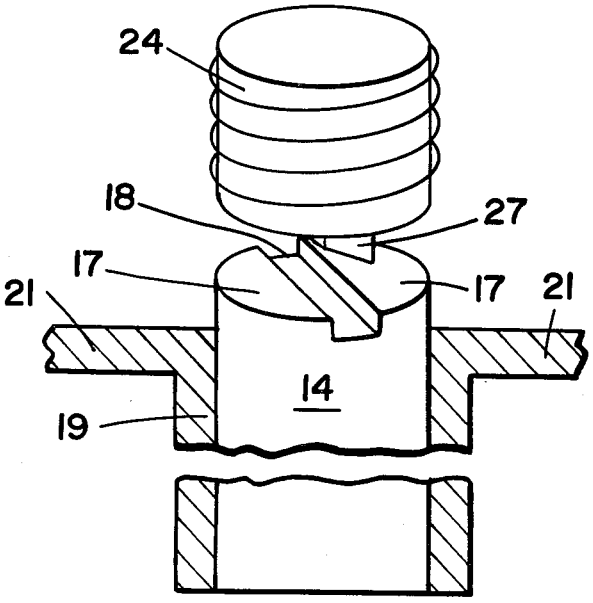
FIG. 3 is a detailed elevation of a print segment assembly of the present invention.

Disposed within the block 11 are a plurality of paramagnetic printing segments 14, which are arrayed transverse to the surface 12 in a seven segment indicia printing pattern known in the art. Each printing segment includes a bar end 16 which is disposed flush with the surface 12 and is intended to form a portion of the selected indicia impression. As shown in FIG. 3, the other end of each printing segment is a cylindrical shaft having a pair of lands 17 extending from the end thereof and separated by a laterally extending slot 18. The printing segments are each surrounded by a jacket 19 of elastomeric material which secured the segments in their respective holes in the block. Also, a layer 21 of elastomeric material extends laterally through the block to separate and define the upper portion 22 and the lower portion 23 of the block. The layer 21 is slightly compressible.

Secured in blind holes in the upper block portion 22 are a plurality of needle electromagnetic driver elements 24, each aligned with one of the printing segments 14. Each driver element 24 is surrounded circumferentially with a jacket 26 of elastomeric material which secures the elements 24 in their respective holes and permits slight rotational movement thereof. The lower end of each driver element is provided with a laterally extending bar or key 27 projecting therefrom, the key being dimensioned and aligned to be received in the slot 18. The keys 27 are directly adjacent to the slots 18. The ends 28 of the keys 27 are non-orthogonally disposed to define a rhombic key configuration.

Figure 4:
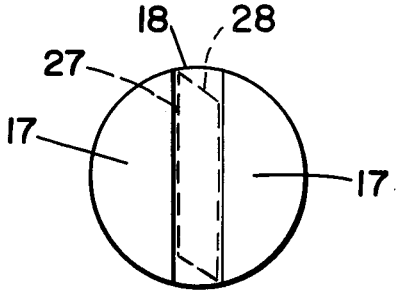
FIG. 4 is a top view of a print segment of the present invention.

In the printing stroke of the present invention, downward pressure is applied to the top of the block to urge it to impinge on the printing surface 13. As the surface 12 impinges on the surface 13, continued pressure on the block causes the layer 21 to compress and the upper block portion 22 to translate toward the lower block portion 23. This action causes the keys 27 to translate into their respective printing segment slots 18 (FIG. 4), although the translatory motion is not sufficient to cause them to bottom out in the slots. Thus no force is transmitted directly to the printing segments, and no printing segment makes a visible impression on the printing surface 13.

Figure 5:
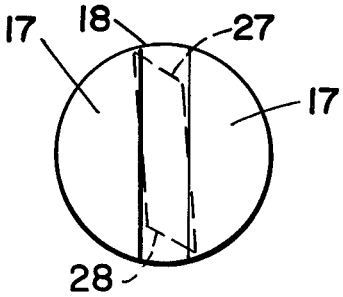
FIG. 5 is a top view of a print segment of the present invention.

When it is desired that a selected printing segment strike the printing surface in printing fashion, the electromagnet of the associated driver element is actuated by control logic not a part of the present invention. The key 27 becomes a pole of the electromagnet, and the distal portions of the rhombic ends 28 are attracted to the nearest portions of the printing segment. The nearest portions of the segment are the lands 17, and the torque resulting from the magnetic attraction rotates the key slightly (FIG. 5). The key is thus caused to misalign with the slot, and it impinges on the lands 17.

The pressure applied to the block is thus transferred directly to the printing segment. As the surface 12 impinges on the surface 13, the downward translation of the upper portion of the block drives the printing segment into the printing surface with sufficient force to form a visible impression thereon. As the printing stroke ends by the block being released, the resiliency of the elastomeric material in the layer 21 and the jackets 19 and 26 cause all of the parts to return to their rest positions.

Figure 6:
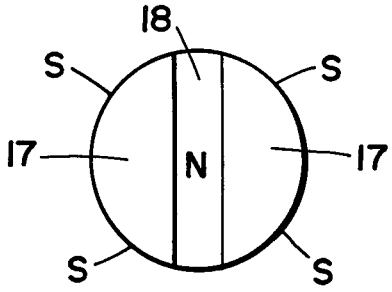
FIG. 6 is a top view of an alternate form of a print segment of the present invention.
Figure 7:
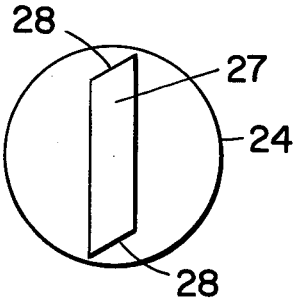
FIG. 7 is a bottom view of a driver element of the present invention.

With reference to FIG. 6, the interaction of each printing segment and its associated driver element may be enhanced. For example, the upper end of the printing segment may be magnetized in circular fashion, with the north pole in the center of the slot 18 and the south pole extending about the circumference of the end of the printing segment. The polarity of the electromagnetic driver element is selected so that the key portion is also a north pole when the electromagnet is energized. It may be appreciated that the like poles, when brought into confronting relationship during the print stroke, will repel and increase the rotation of the driver element.

It may be appreciated that the power consumed in the print stroke is minimal, due to the fact that the block is urged manually into contact with the printing surface. Electrical power is required only to select the printing segments which will extend from the block and strike the printing surface, and no electrical power is employed as motive power for any portion of the printout device. Thus the electrical power drawn by the present invention is quite small, and in fact is sufficiently small to be compatible with the power supply of a hand-held calculator.

It should be noted that it is within the scope of the invention to reverse the key and slot arrangement, providing keys on the ends of the printing segments and slots in the confronting ends of the driver elements.

I claim:

1. A printout device comprising a printing block, a plurality of paramagnetic printing segments disposed in said block and arrayed in indicia-forming patterns, the like ends of said printing segments disposed adjacent to a pressure sensitive printing surface, means for permitting limited longitudinal movement of said printing segments in said block, a plurality of driver elements disposed within said block, each axially aligned with one of said printing segments, slot means and key means interposed between said driver elements and said printing segments and each associated with one of said driver elements and said printing segments for selective longitudinal force coupling therebetween, electromagnetic means for urging one of said slot means and key means to rotate to permit a longitudinal force coupling disposition, and means for permitting limited rotational movement of said slot and key means between a force coupling and non-coupling disposition.

2. The printout device of claim 1, wherein said means for permitting limited longitudinal movement of said printing segments includes elastomeric material interposed between each of said printing segments and said block.

3. The printout device of claim 1, wherein said slot and key means includes a key extending from one end of each of said driver elements, and a slot formed in the confronting end of the associated printing segment dimensioned to receive said key.

4. The printout device of claim 3, wherein said key ends form one pole of said electromagnetic driver elements.

5. The printout device of claim 1, further including a layer of compressible resilient material extending laterally through said block and defining separate upper and lower block portions, said printing segments being secured in said lower portion and said driver elements being secured in said upper block portion.

6. The printout device of claim 1, wherein said means for permitting limited rotational movement includes elastomeric material interposed between the circumference of each of said driver elements and said block.

7. The printout device of claim 3, wherein said key comprises a diametrically extending bar projecting from said one end of each of said driver elements.

* * * * *